US007862021B2

(12) United States Patent
Desfosses

(10) Patent No.: US 7,862,021 B2
(45) Date of Patent: Jan. 4, 2011

(54) GATHERING DEVICE WITH VARIABLE STATIC CHARGING OF BOOKS

(75) Inventor: Michael David Desfosses, Deerfield, NH (US)

(73) Assignee: Goss International Americas, Inc., Durham, NH (US)

( * ) Notice: Subject to any disclaimer, the term of this patent is extended or adjusted under 35 U.S.C. 154(b) by 623 days.

(21) Appl. No.: 11/894,512

(22) Filed: Aug. 20, 2007

(65) Prior Publication Data

US 2008/0048379 A1 Feb. 28, 2008

Related U.S. Application Data

(60) Provisional application No. 60/838,636, filed on Aug. 18, 2006.

(51) Int. Cl.
*B65H 39/00* (2006.01)

(52) U.S. Cl. ..... 270/52.16; 270/52.2; 270/52.26; 270/52.29

(58) Field of Classification Search ..... 270/52.14, 270/52.16, 52.2, 52.26, 52.29, 58.07
See application file for complete search history.

(56) References Cited

U.S. PATENT DOCUMENTS

| | | | |
|---|---|---|---|
| 4,271,451 | A | 6/1981 | Metz |
| 5,730,436 | A | 3/1998 | Viebach et al. |
| 6,267,225 | B1 | 7/2001 | Compera et al. |
| 6,616,134 | B2 | 9/2003 | Maresse et al. |
| 7,066,422 | B1 | 6/2006 | Slocum |
| 2006/0180697 | A1 | 8/2006 | Cree |

*Primary Examiner*—Leslie A Nicholson, III
(74) *Attorney, Agent, or Firm*—Davidson, Davidson & Kappel, LLC

(57) ABSTRACT

A gathering device for gathering books is provided including a gathering conveyor for transporting a book, a variable static charging unit having a voltage output providing a static charge to the book on the gathering conveyor and a controller connected to the variable static charging unit, the controller controlling the voltage output of the variable static charging unit.

18 Claims, 3 Drawing Sheets

GATHERING DEVICE WITH VARIABLE STATIC CHARGING OF BOOKS

This claims the benefit of U.S. Provisional Application No. 60/838,636, filed on Aug. 18, 2006 and hereby incorporated by reference herein.

BACKGROUND

Gathering devices such as perfect binders, saddle stitchers and mailroom inserters may use hoppers or feeders to collect sheet material. A saddle stitcher or perfect binder may for example collect folded printed materials fed from hoppers or feeders onto a saddle or perfect binder conveyor, respectively, to form a magazine or other printed product. In the context of the present application, the term hopper and feeder are used synonymously.

U.S. Pat. No. 6,267,225 purportedly discloses a device for conveying thin workpieces for machines used in the printing technology field having at least one movable conveying element having an electrically insulating contact surface supporting at least one workpiece as it is being conveyed.

U.S. Pat. No. 6,616,134 discloses a device for electrostatically charging a multilayer material web includes electrostatic charge elements assigned to outer sides of the multilayer material web, the charge elements being disposed upline of an inlet of the multilayer material web into a cylinder.

U.S. Publication No. 2006/0180697 purportedly discloses an electrostatic charging system holds a film web to a roll without significant slippage, thus allowing for proper tension control of the web even with extreme differences in tension upstream and downstream of the motorized roll.

SUMMARY OF THE INVENTION

In accordance with an embodiment of the present invention, a gathering device for gathering books includes a gathering conveyor for transporting a book and a variable static charging unit. The variable static charging unit has a voltage output providing a static charge to the book on the gathering conveyor. A controller connected to the variable static charging unit is provided. The controller controls the voltage output of the variable static charging unit.

BRIEF DESCRIPTION OF THE DRAWINGS

A preferred embodiment of the present invention will be elucidated with reference to the drawings, in which.

DETAILED DESCRIPTION

Sheets of gathered books may separate at high speeds as the sheets move down a gathering conveyor, for example, a gathering chain. Typically, a static charge can be induced into the book to prevent separation. However, too much static can pin the sheets to, if provided, steel sheet guides, and too little static can cause pages of the books to separate.

Figure 1:
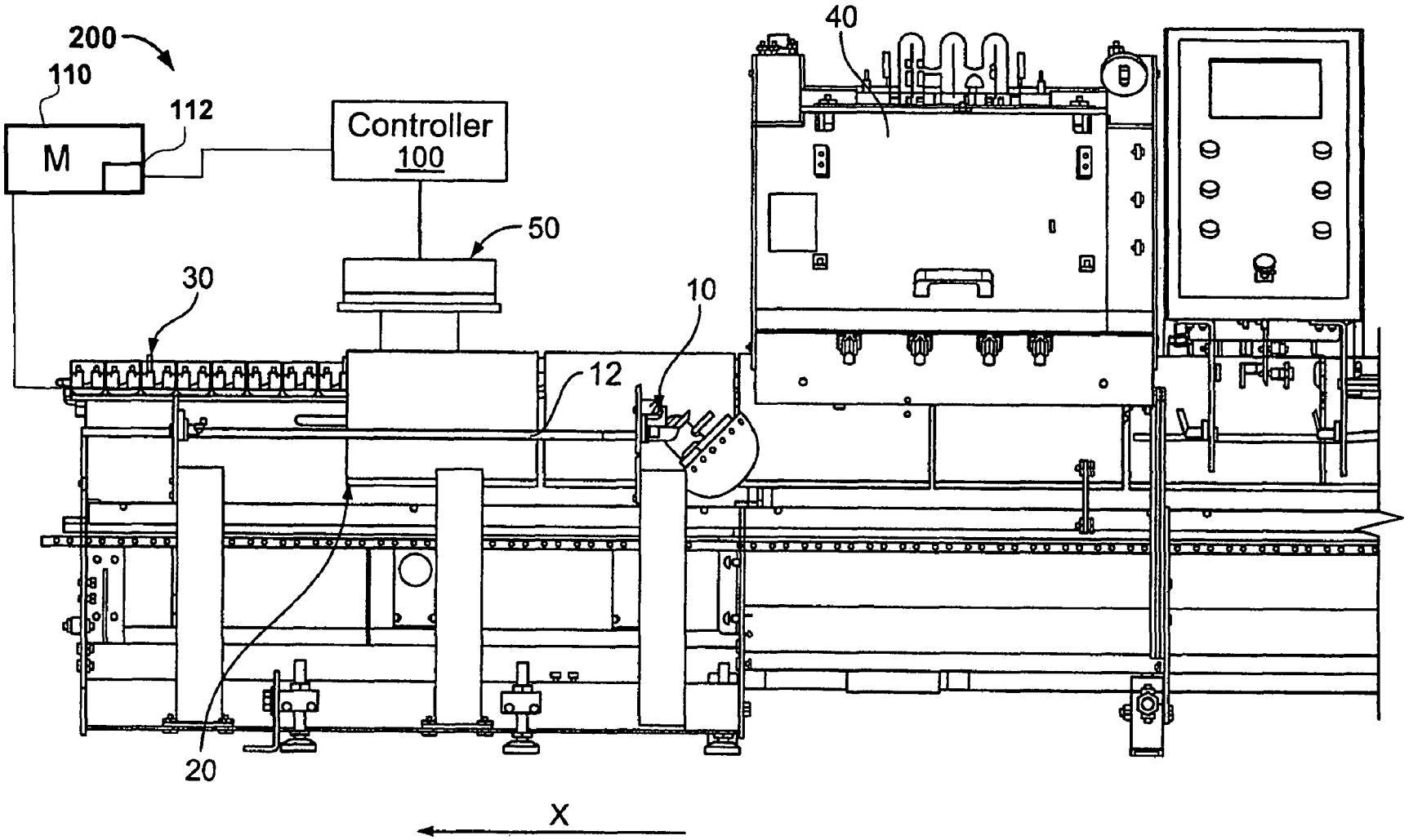
FIG. 1 shows a front view of a section of a gathering device according to the present invention.
Figure 2:
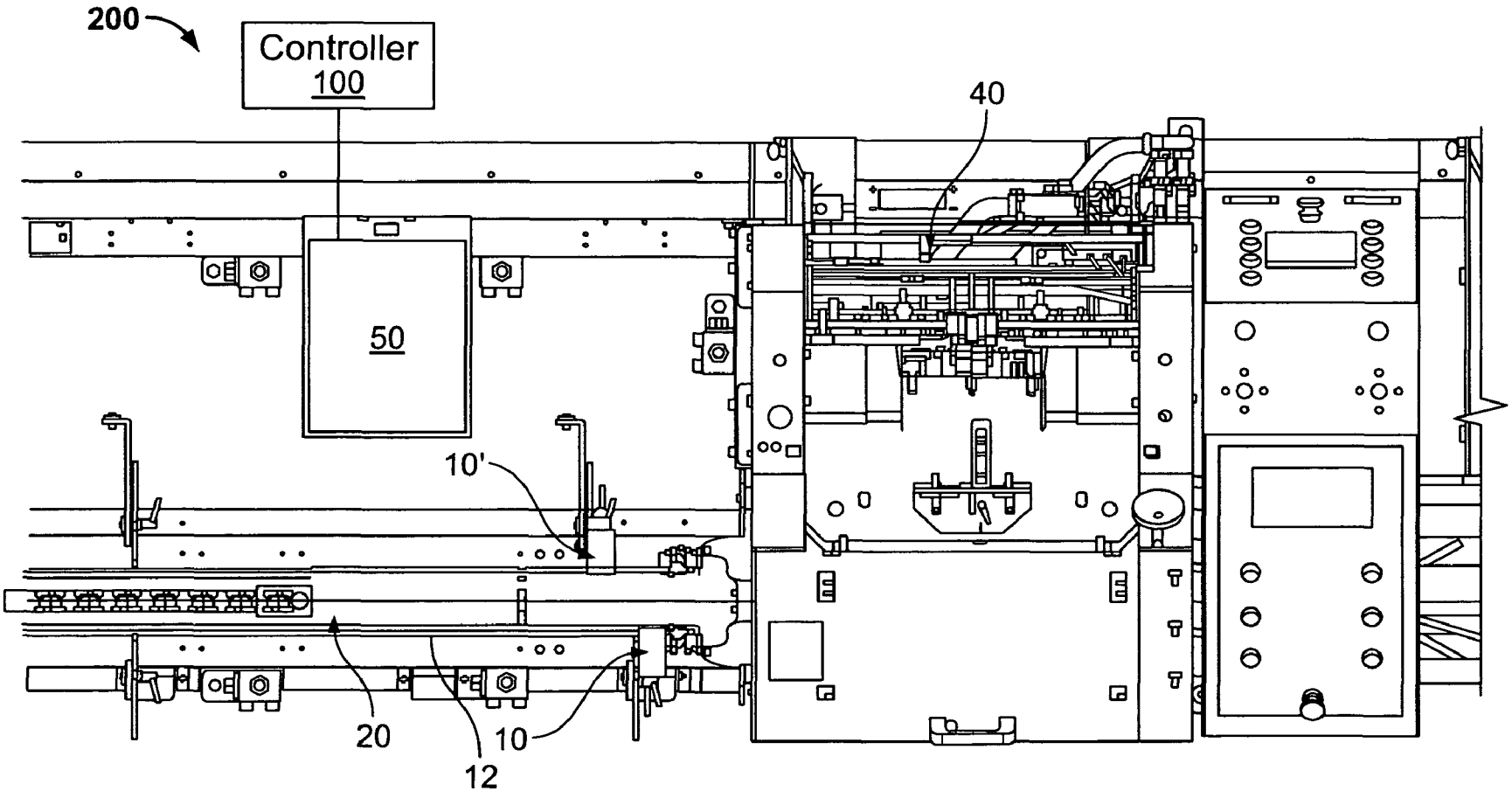
FIG. 2 shows a top view of the FIG. 1 embodiment.

FIGS. 1 and 2 show a gathering device 200 in accordance with an embodiment of the present invention. Gathering device 200 includes a hopper 40, a gathering conveyor, for example, a gathering chain 30, a static charging unit 50 and books 20 being transported on gathering chain 30 in a direction of travel X. Sheet guides 12 guide books 20 traveling on gathering chain 30. More than one hopper 40 may be provided as desired.

Figure 3:
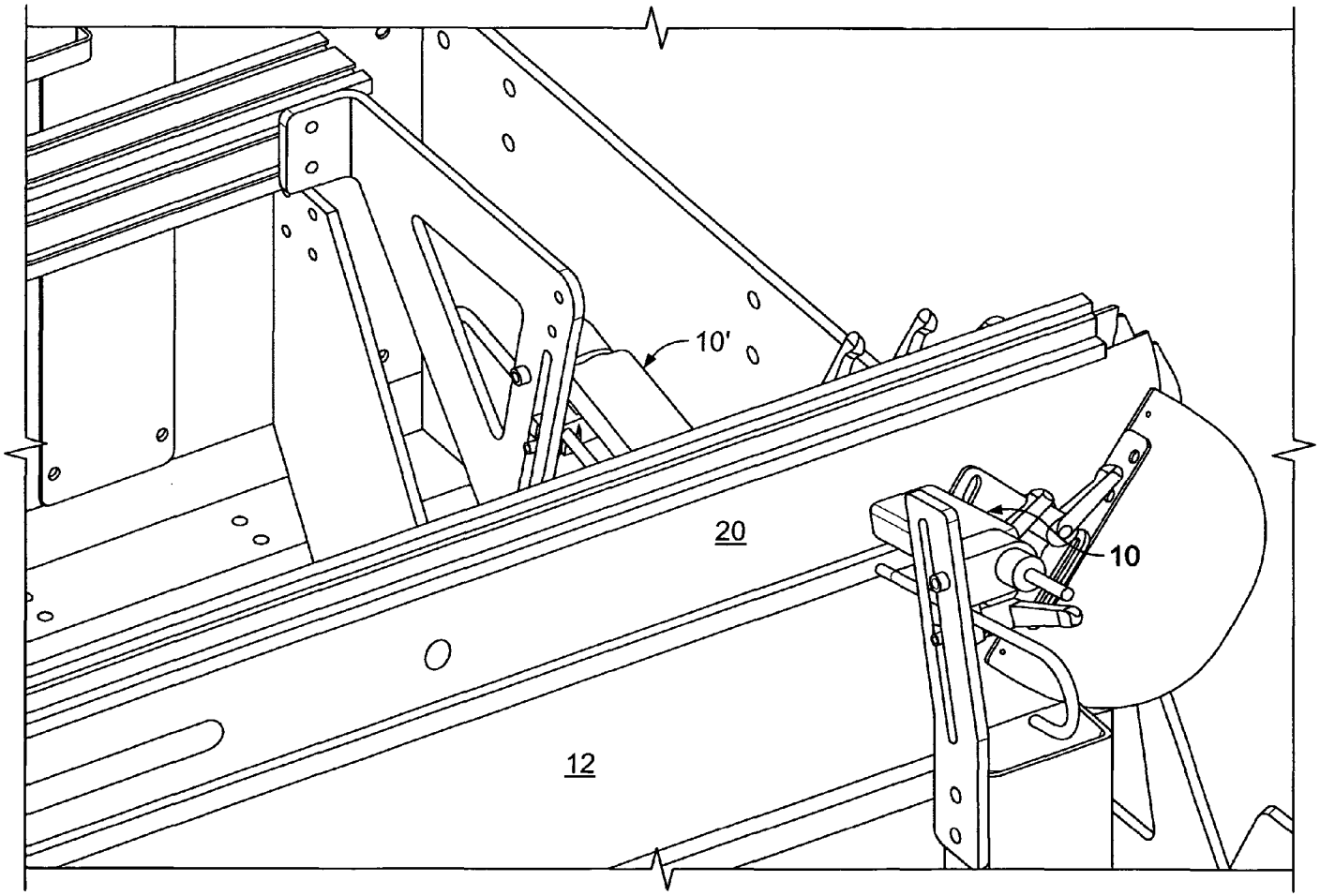
FIG. 3 shows linear pinners.

Pinners, for example, linear pinners 10, 10', are positioned to apply a static charge to books 20 and are connected to static charging unit 50. As shown in FIGS. 2 and 3, linear pinner 10, may be mounted, for example, on a side of gathering chain 30 and linear pinner 10' may be mounted on an opposite side of gathering chain 30. Thus, a static charge may be applied to both sides of books 20.

The amount of static charge introduced into books 20 is a combination of a voltage output by charging unit 50 and a duration of time books are under linear pinners 10 receiving a static charge. Controller 100 adjusts the voltage output of static charging unit 50 according to the actual speed of gathering chain 30. The amount of static charge applied to books 50 is adjusted for starts, stops and speed changes of gathering chain 30. When gathering chain 30 stops and starts in order to, for example, clear a jam, controller 100 adjusts the voltage output of static charging unit 50 to adjust the static charge applied to books 20. Thus, the static charge applied to books 20 is varied accordingly to the speed of gathering chain 30.

In this embodiment, a machine controller 100 controls a speed of gathering chain 30 and a voltage output of static charging unit 50. Alternatively, the controller may not control the speed of gathering conveyor and may, for example, only control the static charging unit.

Pinners 10, 10' receive voltage output from static charging unit 50 and transmit a static charge to book 20. Controller 100 varies voltage output of static charging unit 50 so a proper static charge is supplied to book 20 by linear pinners 10, 10'. A proper static charge is a static charge that does not result in pinning of books 20 to sheet guides 12. The proper static charge may be the maximum charge which does not result in pinning or less than the maximum charge. Furthermore, the desired static charge may be greater than or equal to the charge required to keep pages of the books from separating. The proper static charge may be adjusted as desired by the operator or specifications of a given job.

The controller may determine the speed of gathering conveyor in any suitable manner. The controller may determine the speed, for example, from an encoder 112 on a motor 110 driving the gathering conveyor, from other sensors on the gathering device, or by monitoring the actual speed in another way. Furthermore, the controller may determine the speed of the gathering conveyor from, for example, a speed set for the gathering conveyor at a user interface.

The amount of static voltage provided may be, for example, a function of the book materials or size, the speed of the conveyor, the types and materials of the sheet guides provided, and may be based on predetermined tables or operator knowledge. Moreover, the amount of static charge can be varied as speed varies. By controlling the amount of static charge applied to books, reduced paper jams and improved book quality may result.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A gathering device for gathering books comprising:

a gathering conveyor for transporting a book;

a variable static charging unit having a voltage output providing a static charge to the book on the gathering conveyor;

a controller connected to the variable static charging unit, the controller controlling the voltage output of the variable static charging unit; and a sheet guide spaced from the gathering conveyor, the book traveling between the gathering conveyor and the sheet guide, the static charge being a function of the interaction between the sheet guide and the book.

2. The gathering device as recited in claim 1 wherein the gathering conveyor is a gathering chain.

3. The gathering device as recited in claim 1 wherein the gathering device is a saddle stitcher.

4. The gathering device as recited in claim 1 wherein the static charge is less than a static charge required to pin the book to the sheet guide.

5. The gathering device as recited in claim 1 wherein the book includes a plurality of pages and wherein the static charge applied is greater than or equal to a charge required to keep the pages from separating.

6. The gathering device as recited in claim 1 further comprising a pinner connected to the variable static charging unit and located on a side of the gathering conveyor, the pinner applying the static charge to the book.

7. The gathering device as recited in claim 6 wherein the pinner is a linear pinner.

8. The gathering device as recited in claim 6 further comprising a further pinner located on an opposite side of the gathering conveyor.

9. The gathering device as recited in claim 6 wherein the static charge is a function of a duration of time books are under the linear pinner receiving a static charge.

10. The gathering device as recited in claim 1 wherein the static charge is a function of a composition of the book.

11. The gathering device as recited in claim 1 wherein the static charge is a function of a size of the book.

12. The gathering device as recited in claim 1 wherein the static charge is based on predetermined tables or operator knowledge.

13. The gathering device as recited in claim 1 wherein the static charge is a function of a speed of the gathering conveyor.

14. The gathering device as recited in claim 13 wherein the controller determines the speed of the gathering conveyer from a sensor.

15. The gathering device as recited in claim 14 wherein the sensor is an encoder on a motor driving the gathering conveyor.

16. The gathering device as recited in claim 13 wherein the controller determines the speed of the gathering conveyer from a speed set for the gathering conveyor at a user interface.

17. A gathering device for gathering books comprising:

a gathering conveyor for transporting a book;

a variable static charging unit having a voltage output providing a static charge to the book on the gathering conveyor; and a controller connected to the variable static charging unit, the controller determining a speed of the conveyor and controlling the voltage output of the variable static charging unit as a function of the speed of the conveyor.

18. A gathering device for gathering books comprising:

a gathering conveyor for transporting a book;

a variable static charging unit having a voltage output providing a static charge to the book on the gathering conveyor; and a controller connected to the variable static charging unit, the controller determining a speed of the conveyor and controlling the voltage output of the variable static charging unit as a function of the speed of the conveyor and a function of book materials or size.

* * * * *